US010287219B2

(12) United States Patent
Mazurek et al.

(10) Patent No.: US 10,287,219 B2
(45) Date of Patent: May 14, 2019

(54) PHLEGMATISATION OF AN EXPLOSIVE IN AN AQUEOUS SUSPENSION

(71) Applicant: EURENCO BOFORS AB, Karlskoga (SE)

(72) Inventors: Michal Mazurek, Karlskoga (SE); Karolina Mazurek, Karlskoga (SE)

(73) Assignee: EURENCO BOFORS AB, Karlskoga (SE)

( * ) Notice: Subject to any disclaimer, the term of this patent is extended or adjusted under 35 U.S.C. 154(b) by 632 days.

(21) Appl. No.: 14/899,818

(22) PCT Filed: Jun. 17, 2014

(86) PCT No.: PCT/SE2014/000080

§ 371 (c)(1),
(2) Date: Dec. 18, 2015

(87) PCT Pub. No.: WO2014/204374

PCT Pub. Date: Dec. 24, 2014

(65) Prior Publication Data

US 2016/0137566 A1 May 19, 2016

(30) Foreign Application Priority Data

Jun. 18, 2013 (SE) ..... 1330075

(51) Int. Cl.
*C06B 45/22* (2006.01)
*C06B 23/00* (2006.01)
(Continued)

(52) U.S. Cl.
CPC ..... *C06B 23/005* (2013.01); *B05C 3/08* (2013.01); *B05D 1/007* (2013.01); *B05D 1/18* (2013.01); *C06B 45/22* (2013.01)

(58) Field of Classification Search
CPC ..... C06B 23/005; C06B 45/22
See application file for complete search history.

(56) References Cited

U.S. PATENT DOCUMENTS 3,310,569 A * 3/1967 Staba ..... C06B 41/02 102/204
4,092,187 A 5/1978 Hildebrant et al.
(Continued)

FOREIGN PATENT DOCUMENTS

EP 0026091 A1 4/1981
EP 0492098 A1 7/1992
(Continued)

OTHER PUBLICATIONS

PCT/ISA/210—International Search Report—dated Sep. 17, 2014 (Issued in Application No. PCT/SE2014/000080).
(Continued)

*Primary Examiner* — Aileen B Felton
(74) *Attorney, Agent, or Firm* — Jeffri A. Kaminski; Venable LLP

(57) ABSTRACT

A method for phlegmatizing an explosive in an aqueous suspension including a dispersed phlegmatizing agent. The phlegmatizing agent is deposited on a surface of the explosive at low temperature utilizing opposite electric charges of the phlegmatizing agent and the explosive. Also a device and a phlegmatized explosive.

4 Claims, 3 Drawing Sheets

(51) Int. Cl.

| | |
|---|---|
| ***B05C 3/08*** | (2006.01) |
| ***B05D 1/00*** | (2006.01) |
| ***B05D 1/18*** | (2006.01) |

(56) References Cited

U.S. PATENT DOCUMENTS

| | | | | |
|---|---|---|---|---|
| 4,357,185 | A | 11/1982 | Ringbloom | |
| 4,425,170 | A | 1/1984 | Jones | |
| 2005/0092407 | A1 | 5/2005 | Lee et al. | |
| 2011/0178308 | A1* | 7/2011 | Wuellner ..... | C07D 233/92<br>548/218 |

FOREIGN PATENT DOCUMENTS

| | | | |
|---|---|---|---|
| GB | 574271 | A | 12/1945 |
| GB | 574879 | A | 1/1946 |
| WO | 9918050 | A1 | 4/1999 |

OTHER PUBLICATIONS

PCT/ISA/237—Written Opinion of the International Searching Authority—dated Sep. 17, 2014 (Issued in Application No. PCT/SE2014/000080).

* cited by examiner

PHLEGMATISATION OF AN EXPLOSIVE IN AN AQUEOUS SUSPENSION

CROSS-REFERENCE TO RELATED APPLICATIONS

The application claims priority to Swedish patent application 1330075-1 filed 18 Jun. 2013 and is the national phase under 35 U.S.C. § 371 of PCT/SE2014/000080 filed 17 Jun. 2014.

TECHNICAL FIELD

The present invention concerns a method and a device for phlegmatising an explosive in an aqueous suspension. The invention also concerns an explosive phlegmatised by means of said method and device.

BACKGROUND AND PRIOR ART

It is known in the prior art that an explosive such as PETN, TNT, RDX, or HMX can be phlegmatised by means of surface treatment with a phlegmatising agent, usually a wax, so that the explosive is desensitised in order to prevent accidental initiation of the explosive during processing, for example on extrusion of explosive charges. Phlegmatisation is ordinarily carried out in an aqueous suspension containing a finely dispersed wax. The wax suspension is heated to a temperature immediately above the melting point of the wax, whereupon the wax melts and is deposited as wax particles on the surface of the explosive crystals. The wax suspension is then cooled to a temperature below the solidification point of the wax so that it solidifies and forms a protective coating on the explosive.

A problem with said method is that the process of melting and solidification of the wax is lengthy, consumes energy, and is harmful to the environment.

A further drawback is caused by the unevenness of wax deposition on the explosive surface, resulting in problems such as uncoated surfaces due to uneven distribution of the wax in the aqueous suspension.

OBJECT OF THE INVENTION AND CHARACTERISTICS THEREOF

A principal object of the present invention is to provide a simple, energy-saving, and environmentally friendly method for phlegmatising explosives in an aqueous suspension.

Said object, as well as other objects not enumerated here, is achieved in a satisfactory manner by what is presented in the present specification.

Embodiments of the invention are disclosed herein.

The present invention therefore provides a simpler and more environmentally friendly method of phlegmatisation in an aqueous suspension containing a phlegmatising agent and an emulsifying agent.

The method is characterised by comprising the following production steps in the order specified below:

preparation of an aqueous suspension containing 75-80 wt % of water and 20-25 wt % of an explosive, preparation of a dispersion solution containing 40-80 wt % of water, 20-50 wt % of a phlegmatising agent, 0-10 wt % of a dispersing agent, 2-4 inorganic hydroxides, and 0-2 wt % of stabilisers and preservatives, preparation of a dispersing agent containing 0-10 wt % of water and 90-100 wt % of a dispersion-decomposing substance, dispersion of the explosive in the aqueous suspension by mixing the dispersion solution into the aqueous suspension at a mixing ratio of 4-5 parts by weight of the dispersion solution to 400-500 parts by weight of the aqueous suspension, heating of the aqueous suspension to approx. 30° C., addition of the dispersion decomposer to the aqueous suspension at a mixing ratio of 0.5-1 parts by weight of the dispersion decomposer to 404-405 parts by weight of the aqueous suspension, which causes the dispersion solution to decompose and the phlegmatising agent to be deposited on the surface of the explosive due to their opposite electric charges, heating of the aqueous suspension to 30-45° C., cooling of the aqueous suspension to 15-25° C., separation of the phlegmatised explosive from the aqueous suspension by filtration, washing of the filtered, phlegmatised explosive by rinsing with water, drying of the filtered, washed, and phlegmatised explosive with warm air.

The following applies according to further embodiments of the phlegmatisation method according to the invention:

the dispersion decomposer also contains graphite at a ratio of 0-1 part by weight of graphite to 300-400 parts by weight of water, and the dispersion-decomposing agent contains carboxylic acid.

The present invention also provides a more environmentally friendly and cost-effective phlegmatisation device for phlegmatising an explosive in an aqueous suspension containing a dispersion solution and a dispersion decomposer.

The device is characterised by comprising the following main components:

a first jacketed mixing unit equipped with a first stirrer and a discharge valve for preparing an aqueous suspension of the explosive and mixing the dispersion solution and the dispersion decomposer in the aqueous suspension while stirring, a second mixing unit equipped with a second stirrer and connected to the first mixing unit via a first tube, a regulating valve, and a regulating pump for preparing the dispersion solution, a third mixing unit equipped with a third stirrer and connected to the first mixing unit via a second tube and a second discharge valve for preparing the dispersion decomposer and transferring said dispersion decomposer to the first mixing unit, a jacketed vessel equipped with a filter insert for collecting the aqueous suspension containing a phlegmatised explosive from the first mixing unit and for filtering, washing and drying the phlegmatised explosive.

The present suspension also provides a phlegmatised explosive containing any of the explosives PETN, TNT, RDX or HMX and the phlegmatising agent low-density (LD) polyethylene.

The invention is characterised in that the phlegmatised explosive is phlegmatised by means of said method and said device.

Advantages and Effects of the Invention

The invention provides a series of advantages and effects compared to conventional phlegmatisation methods, with the most important being as follows:

a more even and denser coating, with improvement in compression density from 0.02 [g/cm$^3$] to 0.04 [g/cm$^3$], a safer product having reduced impact sensitivity, with a drop hammer test showing a reduction in impact sensitivity of up to 100%, a simpler, more environmentally friendly, and more cost-effective production method, a coating found to show reduced exudation of the explosive in high-temperature storage, which allows storage time to be prolonged, a safer product showing reduced sensitivity to electrostatic discharges, and a product with improved flowability on use.

The invention has been defined in the following patent claims and will now be described in somewhat greater detail with reference to the attached figures.

Further advantages and effects will become clear on studying and considering the following detailed descriptions of the invention in reference to the attached figures:

FIGS. 1*a, b, c*, and *d* show schematic views of a mechanism for depositing a phlegmatising agent on the surface of an explosive by means of their opposite electric charges.

DETAILED DESCRIPTION OF THE INVENTION

The invention is based on the principle that a phlegmatising agent, preferably polyethylene, is deposited on the surface of the explosive by means of their opposite electric charges. The mechanism is shown schematically in FIGS. 1*a*, 1*b*, 1*c*, and 1*d*.

Figure 1A:
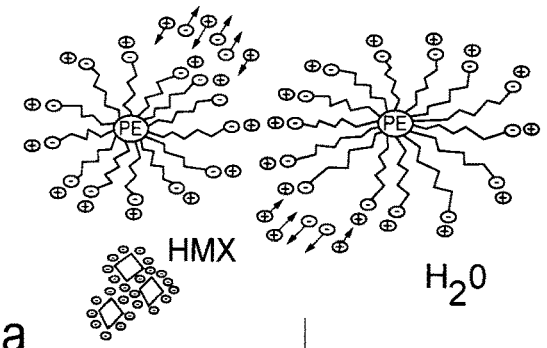

FIG. 1*a* shows an anionic aqueous suspension containing crystals of an explosive to be phlegmatised with a phlegmatising agent, preferably polyethylene (PE), which is dispersed in the aqueous suspension using an anion-active dispersing agent. The continuous circles in FIG. 1*a* represent PE particles, with negatively charged hydrophilic components of the dispersing agent extending outward from said PE particles. Ions having an opposite electric charge are bound to the hydrophilic component of the dispersing agent, which is of great significance for the stability of the dispersion. The electric potential in the double layer decreases linearly with the distance from the surface of the PE particle. When the potential drops below a certain value, the dispersion decomposes and the PE particles agglomerate.

Figure 1B:
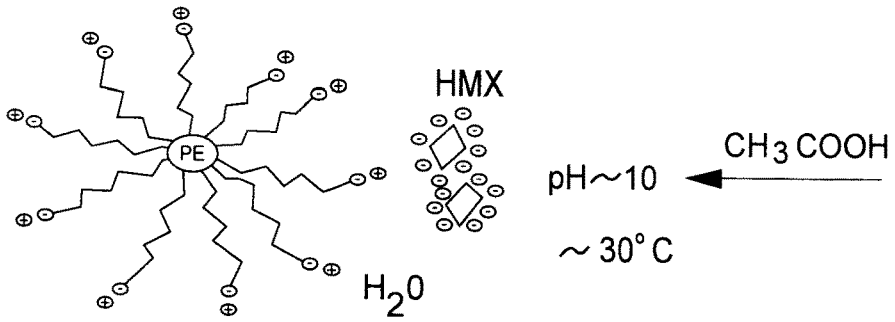
Figure 1C:
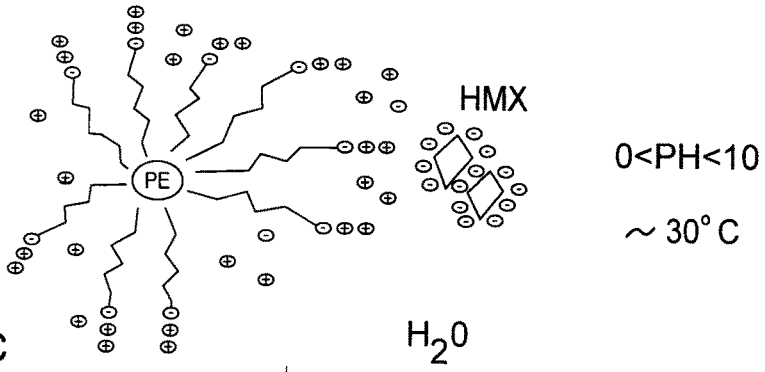
Figure 1D:
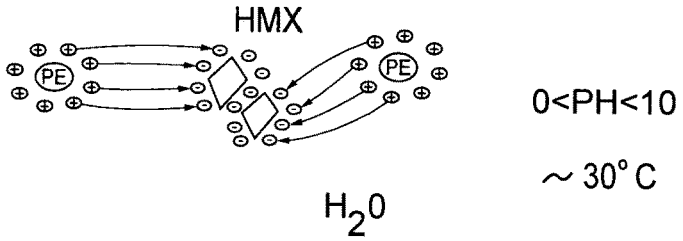

FIGS. 1*b* and 1*c* show the anionic aqueous dispersion during and after addition of a dispersion decomposer (such as $CH_3COOH$).

Addition of the dispersion decomposer causes protonation of the aqueous dispersion by positive ions ($H^+$), which causes the electric potential to drop to a value at which the dispersion decomposes in the aqueous solution and the PE particles are deposited directly on the crystal surface. The dispersion decomposer destabilises the dispersion and imparts a positive charge to the PE particles. The PE particles can no longer agglomerate with one another when the dispersion decomposes because ions of the opposite electric charge on the surface of the explosive crystals have sufficient attractive force (the crystals are considerably larger than PE molecules, which facilitates the attraction) to attract the PE particles onto their surfaces, FIG. 1*d*.

Figure 2:
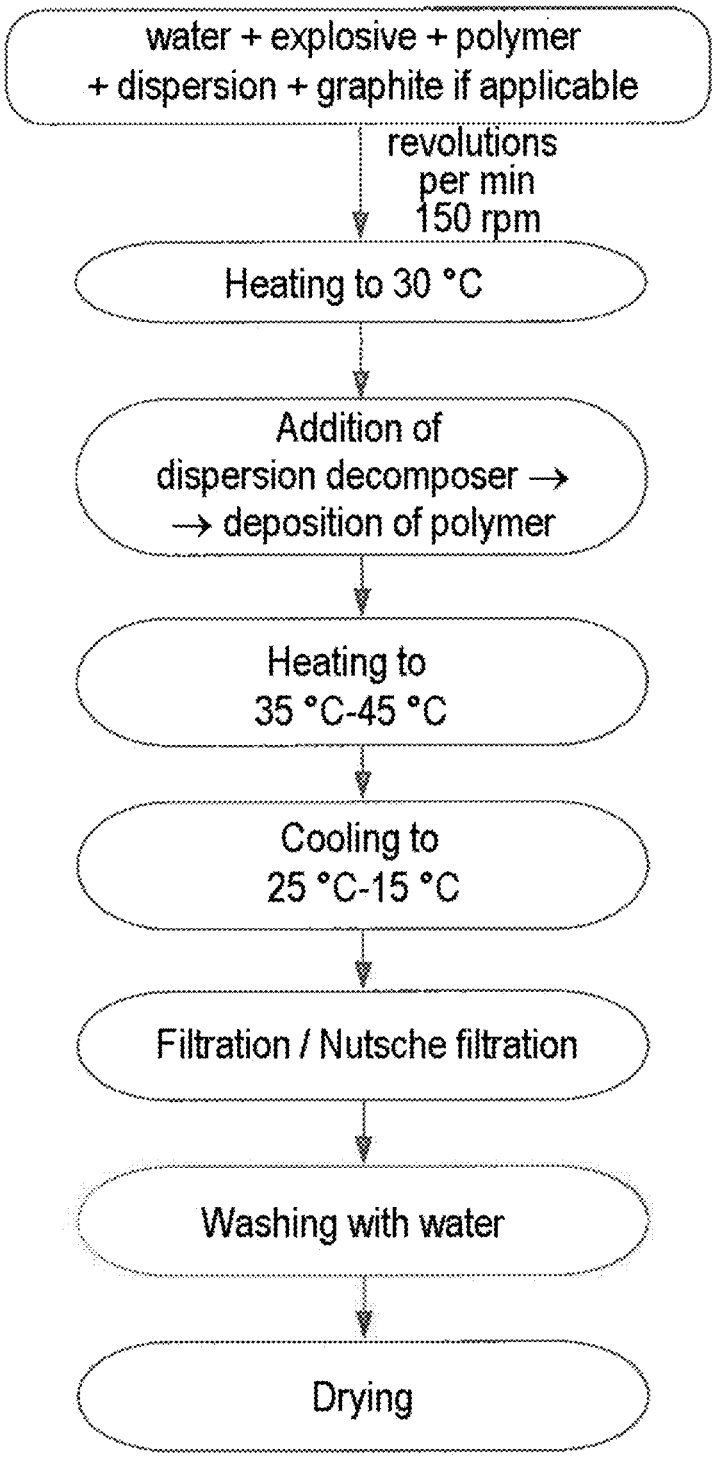
FIG. 2 shows a schematic flow diagram of phlegmatisation of an explosive in an aqueous suspension according to the invention.
Figure 3:
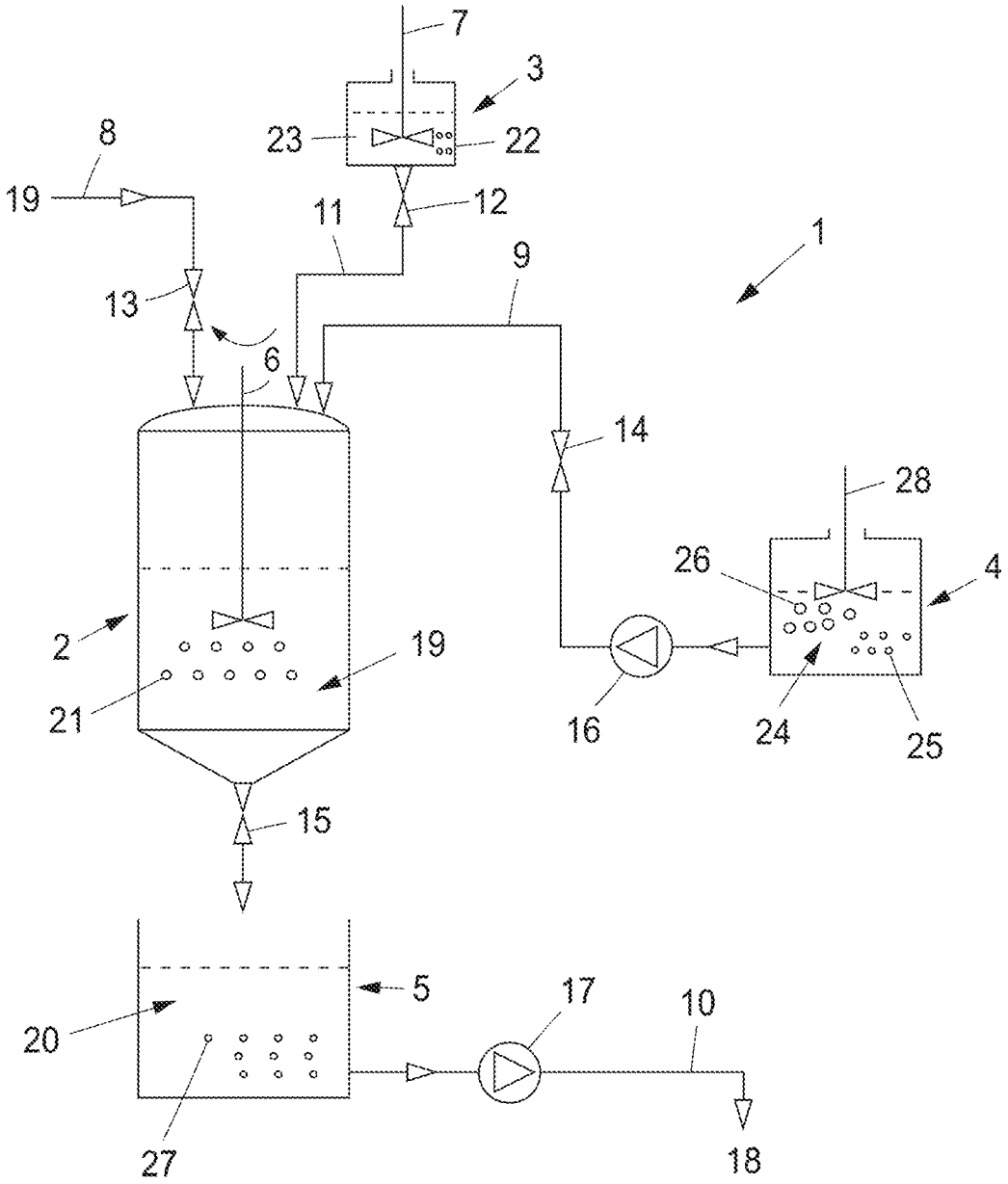
FIG. 3 shows a schematic view of the device used for phlegmatisation of an explosive according to the schematic flow diagram of FIG. 2.

FIG. 2 is a flow chart of phlegmatisation of an explosive in an aqueous suspension 20 that specifies the substances and operations involved. An aqueous suspension 20 containing 75-80 wt % of water 22 and 20-25 wt % of an explosive 21 is prepared. In a parallel step, a dispersion solution 24 and a dispersion decomposing solution 23, also referred to as a dispersion decomposer, are also prepared. The dispersion solution 24 contains 40-80 wt % of water 22, 20-50 wt % of a phlegmatising agent 25, 0-10 wt % of a dispersing agent 26, also referred to as an emulsifier, 2-4 wt % of a pH-increasing agent containing one or more inorganic hydroxides, and 0-1 wt % of stabilisers and preservatives. The dispersion decomposer 23 contains 0-5 wt % of water and 95-100 wt % of a dispersion-decomposing agent.

It has been shown in experiments that polyethylene (PE) waxes, particularly PE of the LD (low-density) type, are suitable as the phlegmatising agent 25. Other phlegmatising agents 25 of interest are PE waxes of the HD (high-density) type, PTFE (polytetrafluoroethylene), MDPE (medium-density polyethylene), LLDPE (linear low-density polyethylene), beeswax, palm oil, montan wax, candelilla wax, and paraffin oil.

The dispersing agent 26, also referred to as a surfactant, is preferably of the anion-active type. Anion-active surfactants are surfactants in which the hydrophilic component is composed of sulphates (R—O—SO3-), sulphonates (R—SO3-), or carboxylates (R—CO2-).

The R group is usually an alkyl group, or in certain cases an aromatic. A suitable dispersing agent 26 contains one or more of the following anion-active surfactants:

ammonium dodecyl sulphate ($CH_3(CH_2)_{10}CH_2OSO_3NH_4$), sodium dodecyl sulphate ($CH_3(CH_2)_{11}OSO_3Na$), sodium dodecyl benzene sulfonate ($C_{12}H_{25}C_6H_4SO_3Na$), sodium laureth sulphate ($CH_3$ $(CH_2)_{10}CH_2(OCH_2CH_2)_nOSSO_3Na$), and sodium stearate ($C_{18}H_{35}NaO_2$).

A suitable pH-increasing agent contains one or more inorganic hydroxides, preferably sodium hydroxide and/or potassium hydroxide. A suitable dispersion-decomposing agent contains a carboxylic acid, preferably acetic acid. The proper choice of a dispersion-decomposing agent improves conductivity and the phlegmatising effect, while allowing more thorough coverage of the explosive crystals with a thin polymer layer. In addition to more even coating, this also provides stronger adhesion. Acetic acid has been shown in experiments to provide particularly favourable results in anionic solutions. The explosive 27, preferably any of the explosives PETN, TNT, RDX or HMX, is mixed with water 22 at a ratio of 100 parts by weight of the explosive 21 to 300-400 parts by weight of water, with graphite being added if applicable at a ratio of 0-1 part by weight of graphite to 300-400 parts by weight of water.

After the aqueous suspension 20, the dispersion solution 24, and the dispersion decomposer 23 have been individually prepared, the dispersion 24 is added while stirring to the aqueous suspension 20 in an amount equivalent to 4-15 parts by weight of dispersion solution 24 to 400-500 parts by weight of the aqueous suspension 20.

After the dispersion solution 24 is mixed in, the aqueous suspension 20 is heated while stirring to approx. 30° C. After this, the dispersion decomposer 23 is added while stirring to the aqueous suspension 20 in an amount equivalent to 0.5-1 part by weight of the dispersion decomposer to 400-500 parts by weight of the aqueous suspension 20. The revolution speed should be in the range of 100-300 rpm, and preferably 150 rpm.

The addition of acetic acid reduces the pH value of the aqueous suspension 20, causing the dispersion to be protonated and decomposed, with the result that polyethylene is deposited as particles and absorbed on the surface of the explosive. In an alternative embodiment, not shown, the dispersion is decomposed via deprotonation of a cationic aqueous suspension 20. In a further alternative embodiment, the dispersion is decomposed by stirring in a non-ionic aqueous suspension 20.

The wax suspension 20 is heated to 35-40° C. in order to reduce the viscosity of the mixture, reduce surface tension, and improve conductivity, and is then slowly cooled to approx. 25° C. The phlegmatised explosive 27 is separated from the aqueous suspension 20 by filtration. The explosive 27 is then washed in purified water to eliminate any residues of the dispersion decomposer and dried, preferably with warm air.

FIG. 2 shows a preferred embodiment of a processing device for phlegmatising an explosive 21 in an aqueous suspension 20 comprising a dispersion solution 24, containing a phlegmatising agent 25 and a dispersing agent 26, and a dispersion decomposer 23. The device 1 comprises a first mixing unit 2 for preparing the aqueous suspension 20 containing the explosive 21 and water 19, a second mixing unit 4 for preparing the dispersion solution 24 containing the phlegmatising agent and the dispersing agent, and a third mixing unit 3 for preparing the dispersion decomposer 23 containing water 19 and a dispersion-decomposing substance 22.

A jacketed collecting vessel 5 having a filter insert, also referred to as a Nutsche filter, is configured under the first mixing unit 2 for collecting, filtering, washing, and drying the phlegmatised explosive 27. The vessel 5 is also connected to a chemical outlet 18 via a third tube 10 and a filter pump 17.

The three mixing units 2, 3, and 4 are positioned relative to one another in such a manner that the dispersion solution 24 and the dispersion decomposer 23 can easily be transferred from the respective mixing unit 4 or 3 to the aqueous suspension 20 in the first mixing unit 2. The second mixing unit 4, which is positioned beside the first mixing unit 2, is connected to the first mixing unit 2 via a first tube 9, a first regulating valve 14, and a pump 16. The third mixing unit 3 is positioned at a higher level than the first mixing unit 2 and connected to the first mixing unit 2 via a second tube 11 and a second drain valve or opening valve 12. A water tube 8 for filling of water 19 is also connected to the first mixing unit 2 via a third regulating valve 13.

In an alternative embodiment, not shown, the third mixing unit 4 is positioned at a higher level than the first mixing unit 2, allowing the difference in height to be used for transferring the dispersion solution 23.

All three mixing units 3,4,5 are equipped with stirrers 6, 7, 25 and heating coils, but the heating coils are not shown in FIG. 2.

The wax suspension 20 containing a phlegmatised explosive is discharged from the first mixing unit 2 via the bottom valve 15 into the Nutsche filter 5. The phlegmatised explosive is then separated/filtered from the aqueous suspension 20 by pumping the aqueous suspension 20 using the filter pump 17 via the insert of the Nutsche filter 5 and via a fourth tube to a chemical outlet 18 for recovery or destruction of the chemical residues.

The invention is not limited to the embodiments shown; rather, it can be modified in various ways within the scope of the patent claims.

The invention claimed is:

1. A method for phlegmatising an explosive in an aqueous suspension containing a dispersion solution and a dispersion decomposer, method comprising:

a) preparing an aqueous suspension comprising 75-80 wt % of water and 20-25 wt % of an explosive, b) preparing a dispersion solution comprising 40-80 wt % of water, 20-50 wt % of a phlegmatising agent, 0-10 wt % of a dispersing agent, 2-4 wt % of inorganic hydroxides, and 0-1 wt % of stabilisers and preservatives, c) preparing a dispersion decomposer comprising 0-10 wt % of water and 90-100 wt % of a dispersion-decomposing agent, d) adding dispersion solution to the aqueous suspension of step (a) at a mixing ratio of 4-5 parts by weight of the dispersion solution to 400-500 parts by weight of the aqueous suspension, e) heating the aqueous suspension to approx. 30° C., f) depositing the phlegmatising agent on a surface of the explosive utilizing opposite electric charges of the phlegmatising agent and the explosive as a result of adding the dispersion decomposer to the aqueous suspension at a mixing ratio of 0.5-1 part by weight of the dispersion decomposer to 404-405 parts by weight of the aqueous suspension, g) heating the aqueous suspension to 30-45° C., h) cooling the aqueous suspension to 15-25° C., i) separating the phlegmatised explosive from the aqueous suspension by filtration, j) washing the phlegmatised explosive by rinsing with water, and k) drying the phlegmatised explosive.

2. The phlegmatisation method according to claim 1, wherein the dispersion decomposer further comprises graphite at a ratio of 0-1 part by weight of graphite to 300-400 parts by weight of water, and wherein the dispersion-decomposing agent comprises carboxylic acid.

3. The phlegmatisation method according to claim 1, further comprising;

depositing a phlegmatising agent on the surface of the explosive utilizing opposite electric charges of the phlegmatising agent and the explosive in an aqueous suspension comprising a dispersion solution and a dispersion decomposer with a phlegmatisation device, the phlegmatisation device comprising:

a first jacketed mixing unit comprising a first stirrer and a discharge valve for preparing the aqueous suspension comprising the explosive and for mixing the dispersion solution and dispersion decomposer in an aqueous suspension while stirring, a second mixing unit comprising a second stirrer connected to the first mixing unit via a first tube, a regulating valve, and a regulating pump for preparing the dispersion solution and transferring the dispersion solution to the first mixing unit, a third mixing unit comprising a third stirrer, the third mixing unit being connected to the first mixing unit via a second tube and a discharge valve for preparing the dispersion decomposer and transferring the dispersion decomposer to the first mixing unit, and a jacketed collecting vessel comprising a filter insert for collecting the aqueous suspension comprising a phlegmatised explosive from the first mixing unit and for filtering, washing, and drying of the phlegmatised explosive.

4. Phlegmatisation method according to claim 2, characterised in that the dispersion decomposing agent is acetic acid.

* * * * *